United States Patent [19]

Haruki et al.

[11] Patent Number: 5,005,051

[45] Date of Patent: Apr. 2, 1991

[54] ELECTROPHOTOGRAPHIC IMAGE RECORDING APPARATUS USING AMORPHOUS SILICON HYDRIDE PHOTOSENSITIVE DRUM

[75] Inventors: Shinichi Haruki; Yhuzi Furuya; Akio Tsujita, all of Katsuta, Japan

[73] Assignee: Hitachi Koki Co., Ltd., Tokyo, Japan

[21] Appl. No.: 498,518

[22] Filed: Mar. 26, 1990

[30] Foreign Application Priority Data

Mar. 24, 1989 [JP] Japan ..... 1-73002

[51] Int. Cl.[5] ..... G03G 15/02; G03G 15/16; G03G 21/00

[52] U.S. Cl. ..... 355/221; 355/215; 355/219; 355/274; 355/297; 355/300

[58] Field of Search ..... 355/215, 219, 221, 225, 355/273, 274, 275, 281, 300

[56] References Cited

U.S. PATENT DOCUMENTS

| | | | |
|---|---|---|---|
| 3,510,903 | 5/1970 | Stoever et al. | 355/300 X |
| 4,093,368 | 6/1978 | Nishikawa | 355/215 X |
| 4,607,936 | 8/1986 | Miyakawa et al. | 355/210 |

FOREIGN PATENT DOCUMENTS

| | | | |
|---|---|---|---|
| 0049839 | 4/1977 | Japan | 355/221 |
| 0202574 | 12/1982 | Japan | 355/215 |
| 0079268 | 5/1984 | Japan | 355/221 |
| 0226370 | 12/1984 | Japan | 355/300 |
| 0050170 | 3/1986 | Japan | 355/221 |
| 0273892 | 11/1988 | Japan | 355/300 |
| 63-267976 | 11/1988 | Japan . | |

*Primary Examiner*—A. T. Grimley
*Assistant Examiner*—Christopher Horgan
*Attorney, Agent, or Firm*—Sughrue, Mion, Zinn, Macpeak & Seas

[57] ABSTRACT

An electrophotographic recording apparatus using an amorphous silicon hydride photosensitive drum for recording images through processes comprising uniformly charging the drum, exposing the drum to light to form a latent image thereon, developing the latent image and transferring the developed image onto a recording medium wherein the charging and transferring processes are implemented by corona dischargers. To prevent pale or blurred image recording which occurs when the image recording is resumed after expiration of a long period of time, a shielding means is provided in association with each of the corona dischargers for shielding the corona discharger to interrupt atmospheric contact with the peripheral surface of the photosensitive drum.

13 Claims, 3 Drawing Sheets

ELECTROPHOTOGRAPHIC IMAGE RECORDING APPARATUS USING AMORPHOUS SILICON HYDRIDE PHOTOSENSITIVE DRUM

BACKGROUND OF THE INVENTION

The present invention relates generally to an image recording apparatus, such as a copying machine, printer. More particularly, the invention relates to an electrophotographic image recording apparatus with a photosensitive drum having a photosensitive surface made of amorphous silicon hydride.

Image recording by way of electrophotographic technique was invented by Carlson and has been extensively used in copying machines and printers. In the electrophotography process, a photosensitive member is uniformly charged by a corotron and is exposed to light to form a latent image thereon. Electrostatically charged fine particles, i.e., toner powders, are applied onto the photosensitive member to be deposited on the latent image by the electrostatic attraction between the latent image and the toner powders, whereby the latent image is developed. In the subsequent step, the toner image is transferred onto a recording medium and is thermally fixed thereon. In the transfer process, a corotron is also disposed at a transfer position.

Amorphous silicon hydride has recently occupied attention as a material for a photosensitive member for its high surface hardness and less wearness in comparison with conventionally used selenium (Se) or cadmium sulfide (CdS). Amorphous silicon hydride may realize a maintenance free photosensitive member, since no substantial wear would occur when it contacts a recording medium or a cleaning brush or blade.

However, in the image recording with the amorphous silicon hydride drum, a first few hundred sheets are printed in pale or blurred form when the printing or recording is resumed after elapse of a considerably long period of time, say more than 10 hours. This phenomenon will be hereinafter be referred to as "initial recording defect" or "initial printing defect". The pale or blurred portion is observed locally of the recording medium, which portion extends in the circumferential direction of the photosensitive drum in the range of from 10 to 20 millimeters and has a width of about three fourth (¾) with respect to the axial length of the drum. When the image recording is further carried out, the pale or the blurred portion disappears and the entire face of the recording medium is recorded with clear and fine images. Such an initial recording defect does not fail to occur when the image recording is not resumed until more than a certain period of time has elapsed. When the image recording is intermittently carried out with an interval of a certain period of time, the pale or blurred portion tends to spread substantially all over the recording medium.

SUMMARY OF THE INVENTION

The present invention has been made to obviate the problem that has arisen in an image recording apparatus using an amorphous silicon hydride drum. It is therefore an object of the invention to eliminate an initial recording defect which occurs when the image recording is resumed after expiration of a long period of time.

Experiments were conducted by the present inventors to fathom the cause of the initial printing defect. Through the experiments, it is found that the pale or blurred portions on an image recording medium correspond to the positions of charging and transferring units. It is further found that a portion of the photosensitive drum which has long been confronted with a corotron causes to yield the initial recording defect. Based on the experimental results, presumption can reasonably be made so that active substances or gases are produced by the corotrons and remain within the transfer and charging units after the image recording is finished and that such substances adhere to the photosensitive drum and form atomic or molecular layers made up of atoms or moleculars differing from those of the amorphous silicon hydride. It would be for this reason that the performance of the photosensitive drum is degraded and the reproduced image becomes defective.

In accordance with the present invention, there is provided an electrophotographic recording apparatus for recording an image on a recording medium comprising a photosensitive member rotatable about its own axis and having a peripheral surface made of amorphous silicon hydride, the photosensitive member being movable in a predetermined direction and at a predetermined speed at the time of image recording, charging means for uniformly charging the photosensitive member, the charging means comprising a corona discharger, exposure means for exposing the uniformly charged photosensitive member to light to form a latent image thereon, developing means for developing the latent image and providing a visible image on the photosensitive member, transfer means for transferring the visible image onto the recording medium, the transfer means comprising a corona discharger, the recording medium being transported between the transfer means and the photosensitive member while contacting the surface of the photosensitive member, and shielding means provided in association with each of the corona dischargers for shielding the corona discharger to interrupt atmospheric contact with the surface of the photosensitive member.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWINGS

FIGS. 4 and 5 are cross-sectional side views each showing an essential portion of an electrophotographic printer according to another embodiment of the present invention wherein FIG. 4 shows a shielding member which is in a closed state and FIG. 5 shows the shielding member which is in an open state;

DETAILED DESCRIPTION OF THE PREFERRED EMBODIMENTS

Figure 1:
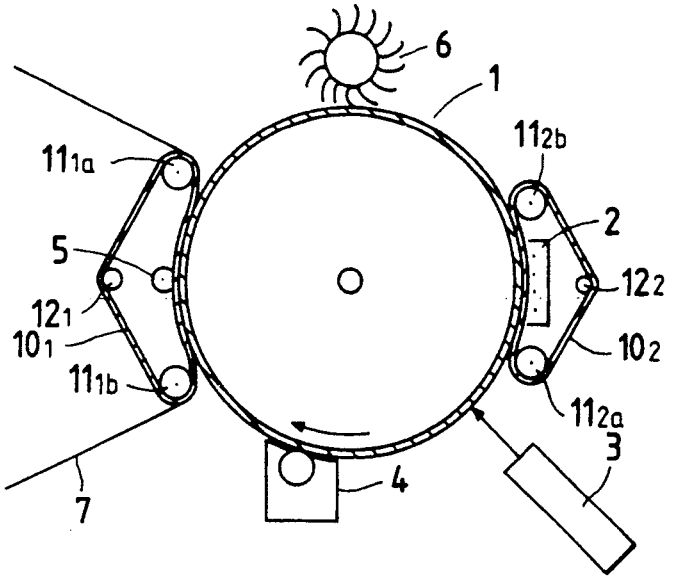
FIG. 1 is a cross-sectional side view showing an electrophotographic printer according to one embodiment of the present invention.

Referring to FIG. 1, there is shown an electrophotographic printer according to one embodiment of the present invention. The printer includes a photosensitive drum 1 rotatable about its own axis and having a peripheral surface made of amorphous silicon hydride. The drum rotates in a predetermined direction (clockwise direction in FIG. 1) and at a predetermined peripheral speed at the time of image recording. Along the periphery of the drum 1, there is disposed a charging unit 2 for uniformly charging the photosensitive drum to a first polarity. The charging unit 2 is comprised of a corona discharger or a corotron. In downstream of the charging unit 2, an exposure light source 3 is disposed for exposing the photosensitive drum to light to form a latent image. The light source 3 may be a semiconductor laser or an LED array. In downstream of the exposure light source 3, a developing unit 4 is disposed for developing the latent image with toner powders charged to a second polarity opposite the first polarity. A transfer unit 5 is disposed downstream of the developing unit 4 for transferring the toner image onto a recording medium. The transfer unit 5 is also comprised of a corona discharger or a corotron. In downstream of the transfer unit 5, there is provided a cleaning brush 6 for removing the toner powders remaining on the surface of the drum 1.

Figure 2:
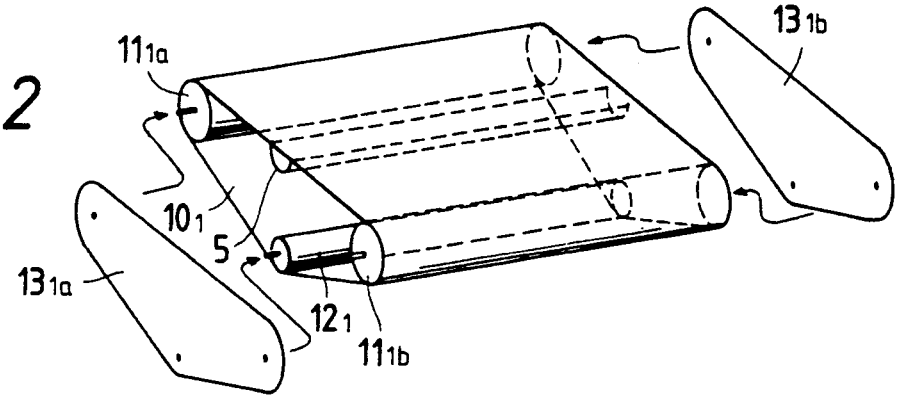
FIG. 2 is a fragmental perspective view showing a transfer unit of the printer shown in FIG. 1.

A first endless belt unit serving as a shielding means is provided in association with the transfer unit 5, which includes an endless belt $10_1$, a drive roller $11_{1a}$, an idle roller $11_{1b}$ and a tension roller $12_1$. As shown in FIG. 2, the first endless belt unit further includes a pair of lids $13_{1a}$, $13_{1b}$. The lids $13_{1a}$, $13_{1b}$ are attached to both sides of the belt $10_1$ to hermetically seal the belt unit. Thus, the transfer unit 5 is confined within the first endless belt unit and thus atmospheric contact of the transfer unit 5 with the peripheral surface of the photosensitive drum 1 is thereby interrupted. The lids $13_{1a}$, $13_{1b}$ are formed with holes allowing to receive axes of the three rollers and the latter are rotatably supported by the lids $13_{1a}$, $13_{1b}$. The endless belt $10_1$ is movably mounted on the drive roller $11_{1a}$, the idle roller $11_{1b}$ and the tension roller $12_1$ wherein the drive roller $11_{1a}$ which is operatively coupled to a motor (not shown) drives the belt, and the tension roller $12_1$ imparts a tension to the belt $10_1$. The belt $10_1$ passes through a gap between the transfer unit 5 and the photosensitive drum 1 while being held in surface contact with the periphery of the drum 1. At the time of image recording, the belt $10_1$ is driven by the drive roller $11_{1a}$ at the same speed as the peripheral speed of the drum 1 and in the same direction in which the drum rotates.

A second endless belt unit also serving as the shielding means is provided in association with the charging unit 2 in the similar fashion to the first endless belt unit. Similar to the transfer unit 5, the charging unit 2 is also confined within the second endless belt unit and thus atmospheric contact of the charging unit with the peripheral surface of the drum is interrupted. The corresponding components included in the second endless belt unit are denoted by the similar reference numerals replacing only the subscript numeral "1" with "2", and therefore the duplicate description is omitted herein. Both the endless belts $10_1$ and $10_2$ are brought into contact with the photosensitive drum 1 at the time when printing is carried out. In accordance with the movement of the endless belt $10_1$, a printing sheet 7 is conveyed into a gap between the endless belt $10_1$ and the photosensitive drum 1 and is brought into facial contact with the photosensitive drum 1. Image transfer by the transfer unit 5 is implemented through the endless belt $10_1$. Likewise, the charging operation by the charging unit 2 is implemented through the endless belt $10_2$.

Suitable materials for the endless belts $10_1$, $10_2$ are nitrile rubber, chloroprene rubber, butyl rubber, fluorine-containing rubber, silicone rubber, isoprene rubber, styrene-butadiene rubber, urethane rubber, polyacrylic rubber, chlorosulfonated polyethlene rubber, polysulfide rubber, ethylene-propylene rubber, epichlorohydrin rubber, and polybutadiene rubber. It is preferred that metal particles of chromium, molybdenum, tungsten or the like be dispersedly diffused into the above-mentioned materials so that the resultant materials are semiconductive. Tetrafluoroethylene resin, tetrafluoroethylene-hexafluoropropylene resin, perchloroalkoxyl-polymer or the like may further be coated on the above-mentioned semiconductive rubber materials to improve anti-wearing performance of the endless belt. Further, in order that the peripheral surface of the drum may be ground by the endless belt, high rigidity fine particles of $SiO_2$, $TiO_2$, $Al_2O_3$, $Si_3N_4$, SiC, TiC, TiN, artificial diamond or the like may either be coated on the surface of the belt or be dispersed into the above-mentioned belt materials.

According to the above-described embodiment, the charging unit 2 and the transfer unit 5 are shielded from the photosensitive drum 1 by means of the endless belts $10_1$, $10_2$, so that not only during printing but also after printing, active substances or gaseous matters produced from the corotrons are confined within the endless belt units and the belts interrupt the active substances or gaseous matters from contacting the photosensitive drum 1. As a result, no initial printing defect occurred even if the printing operation was resumed after elapsing a considerably long period of time. This was proved by the experiments wherein twelve-hour consecutive printing was repeatedly carried out at a twelve-hour interval, and about five millions printing papers were printed in total. The investigation of each printing paper indicated that no initial printing defect occurred.

Experiments were further conducted wherein after the printing is finished, the endless belts $10_1$, $10_2$ were driven at a speed different from the peripheral speed of the drum and in the same direction in which the photosensitive drum rotates. Subsequently, the endless belt were driven in the direction opposite the rotational direction of the drum. As a result, the quality of the printed image was improved. This is due to the fact that an unwanted material deposited on the surface of the drum is removed by the grinding material contained in the belt. To grind the surface of the photosensitive drum 1, the endless belt may be driven at a speed different from the peripheral speed of the drum. However, it is found through the experiments that excellent grinding effects were attained if the endless belt were driven at a speed about two times higher than the peripheral speed of the drum and for a period of time during which the drum rotates twenty times or so.

Figure 3:
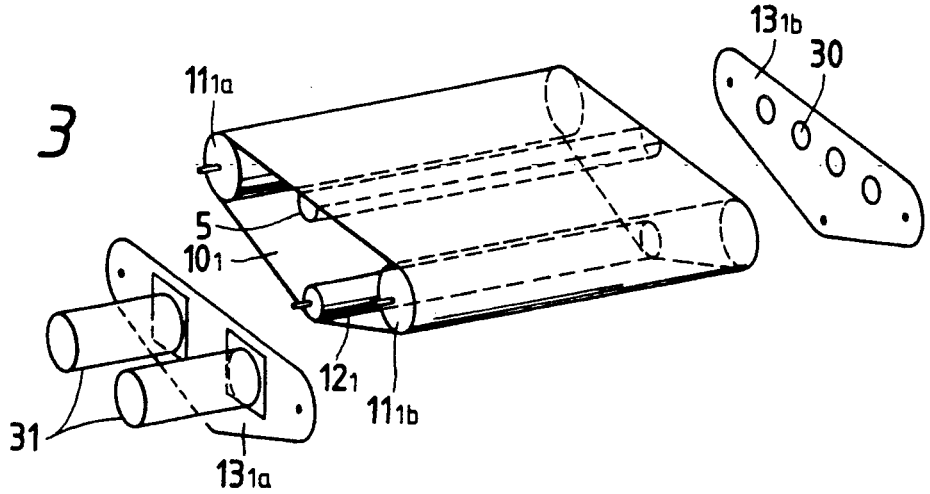
FIG. 3 is a fragmental perspective view showing a modification of the transfer unit shown in FIG. 1.

FIG. 3 is a modification of the embodiment shown in FIG. 2. In the modification, a plurality of holes 30 are formed on one lid $13_{1b}$ for introducing air into the transfer unit 5, and a pair of gas discharge ducts 31 in the form of cylinder are secured to the other lid $13_{1a}$ for exhausting the active substances or gaseous matters. A vacuum pump (not shown) is coupled to the gas discharge ducts 31 for sucking the active substances or gaseous matters produced by the corotron. By the provision of the gas discharge ducts 31 in the belt unit, the active substances or gaseous matters are prevented from being accumulated within the belt unit and thus possibility that the initial printing defect occurs can further be reduced. Although the lids needs to be attached to the belt unit after the printer is powered off, they may be detached therefrom during the printer is in operation to release the active agent out of the belt unit.

In the arrangement shown in FIG. 1, the charging unit 2 and the transfer unit 5 are disposed in confronting relation to the photosensitive drum 1. However, these units may not be so arranged but be arranged to confront the face of the associated endless belt $10_1$ or $10_2$. Further, although it has been described so that the surface of the photosensitive drum 1 is ground with the endless belt after the image recording is finished, the grinding of the drum surface may be effected after the image recording and upon exchanging the belt to another endless belt for grinding exclusive use. Grinding the drum with such a belt is advantageous in comparison with grinding with conventionally used cleaning brush in that the area of the belt which contacts the drum is increased, so that the grinding efficiency can be enhanced.

Figure 4:
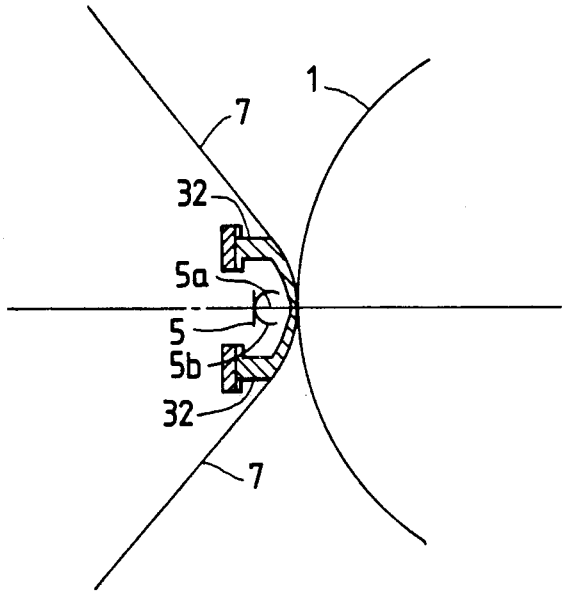
Figure 5:
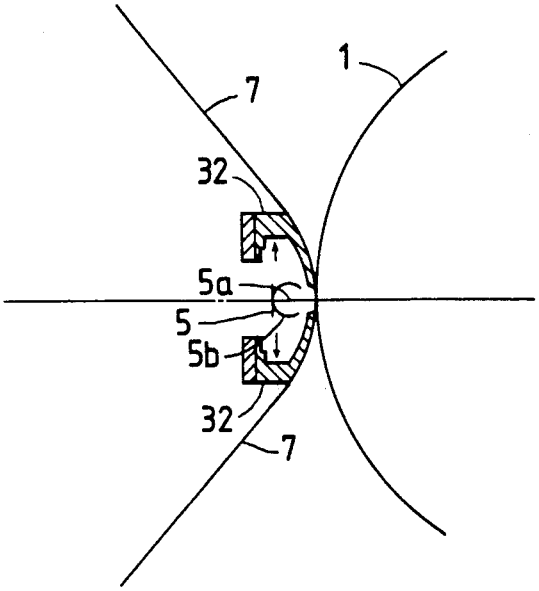

FIGS. 4 and 5 show a part of an electrophotographic printer or a copying machine according to another embodiment of the present invention. The apparatus shown therein includes a photosensitive drum 1 made of amorphous silicon hydride, a sheet guide 32 having a sheet guide surface confronting the peripheral surface of the drum 1, and a transfer unit generally designated by reference numeral 5 which is disposed inside the sheet guide 32. The transfer unit 5 includes a corotron wire 5*a* and a corotron casing 5*b*. The sheet guide 32 serves not only as a guide means for guiding a sheet of paper 7 along the sheet guide surface but also as a shielding means. The sheet guide 32 is separated into upper and lower parts which can be vertically moved toward and away from each other as shown in FIGS. 4 and 5. When the upper and lower parts of the sheet guide 32 are vertically moved toward each other and brought to the contacted state as shown in FIG. 4, the sheet guide 32 has a U-shaped cross-section as a whole and prevents the corotron wire 5*a* from atmospherically contacting the peripheral surface of the photosensitive drum 1. When, on the other hand, the upper and lower parts of the sheet guide 32 are vertically moved away from each other as shown in FIG. 5, an opening is formed between the tip ends of the upper and lower parts of the sheet guide 32 to allow the corotron wire 5*a* to atmospheric contact with the peripheral surface of the drum 1.

When the printing is not carried out, the corona discharge is not performed by the corotron wire 5*a*. In this state, the sheet guide 32 is closed as shown in FIG. 4. Therefore, after the printing is finished, active substances or gaseous matters remaining in the transfer unit 5 are not allowed to touch the drum surface. On the other hand, when the printing is being carried out, the upper and lower parts of the sheet guide 32 is brought into a spaced part condition as shown in FIG. 5, thereby allowing the corotron wire 5*a* to be in confrontation with the drum surface through the printing paper 7.

Although FIGS. 4 and 5 show the shielding means provided in association with the transfer unit 5, the charging unit (not shown in FIGS. 4 and 5) is also shielded by the similarly configured unit.

Figure 6:
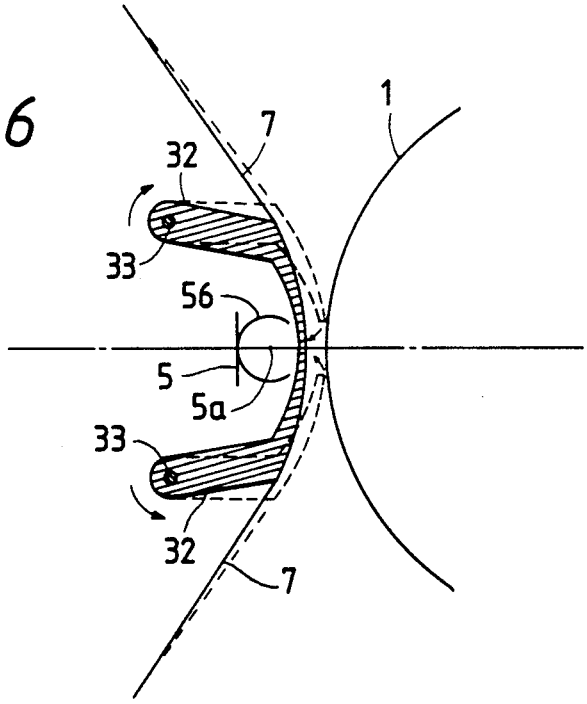
FIG. 6 is a cross-sectional side view showing a modification of the shielding member shown in FIGS. 4 and 5.

FIG. 6 is a modification of the embodiment shown in FIGS. 4 and 5. In this modification, the sheet guide 32 is also separated into upper and lower portions, each of which is pivotally movable about the respective pins 33. Specifically, when the upper half of the sheet guide 32 is rotated about the associated pin in the clockwise direction and the lower half of the sheet guide 32 is rotated about the associated pin in the counterclockwise direction, these two portions are brought into engagement with each other, whereas when the upper and lower halves of the sheet guide 32 are rotated in the opposite directions, the corotron wire 5*a* is allowed to be in confrontation with the photosensitive drum 1 through the printing paper 7. The closing operation of the sheet guide also serves to separate the printing sheet from the drum surface.

Figure 7:
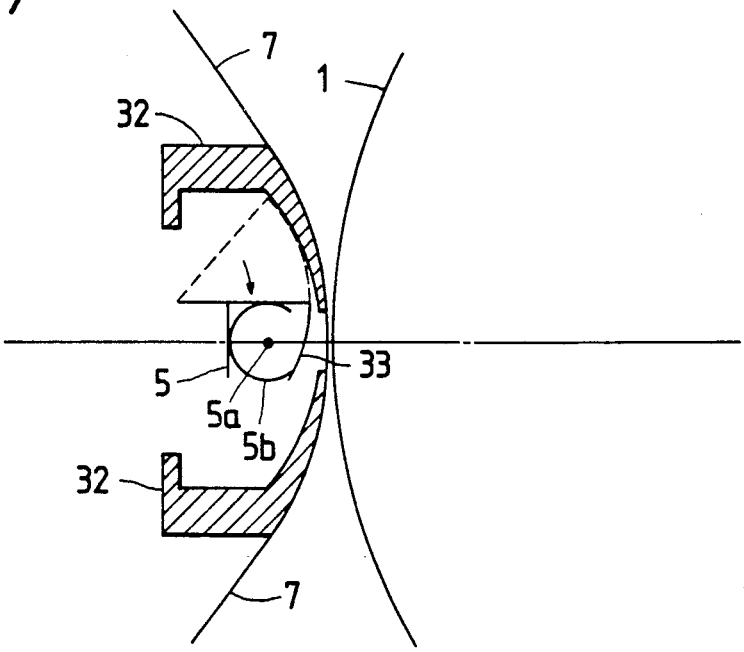
FIG. 7 is a cross-sectional side view showing another modification of the shielding member shown in FIGS. 4 and 5.

FIG. 7 shows still another modification of the embodiment shown in FIGS. 4 and 5. In this modification, the sheet guide 32 is fixedly provided and an opening is formed at the top of the sheet guide surface, and a shielding member 33 is provided to directly shield the corotron wire 5*a* in cooperation with the corotron casing 5*b*. When it is intended not to distribute the active agents or gaseous matters, the shielding member 33 is pivotally moved from the rest position indicated by a dotted line to the shielding position indicated by a solid line.

Figure 8:
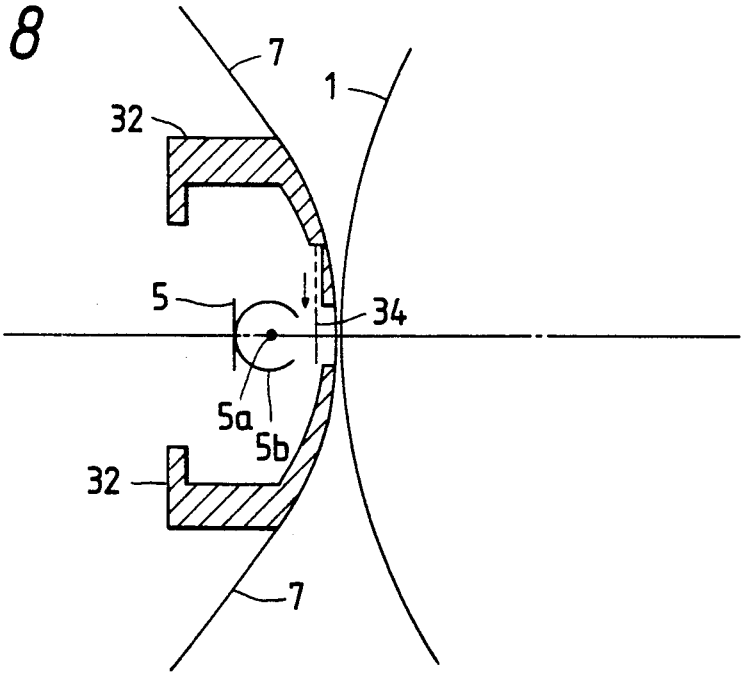
FIG. 8 is a cross-sectional side view showing still another modification of the shielding member shown in FIGS. 4 and 5.

FIG. 8 shows yet another modification of the embodiment shown in FIGS. 4 and 5. In this modification, like the modification of FIG. 7, the sheet guide 32 is fixedly provided and an opening is formed at the top of the sheet guide surface. A shutter 34 is provided as a means for the shielding member, which is movably provided to cover the opening of the sheet guide 32. When the shutter 34 is moved from the retracted position indicated by a dotted line to the closing position indicated by a solid line, the active agents or gaseous matters are prevented from being in touch with the drum surface.

While the present invention has been described with reference to specific embodiments, it would be apparent for those skilled in the art that a variety of changes and modifications may be made without departing from the scope and spirit of the present invention. For example, in lieu of the photosensitive drum rotatable about its own axis, a belt-like photosensitive member is also available in the present invention.

What is claimed is:

1. An electrophotographic recording apparatus for recording an image on a recording medium comprising:

a photosensitive member rotatable about its own axis and having a peripheral surface made of amorphous silicon hydride, said photosensitive member being movable in a predetermined direction and at a predetermined speed at the time of image recording;

charging means for uniformly charging said photosensitive member, said charging means comprising a corona discharger;

exposure means for exposing said uniformly charged photosensitive member to light to form a latent image thereon;

developing means for developing the latent image and providing a visible image on said photosensitive member;

transfer means for transferring the visible image onto the recording medium, said transfer means comprising a corona discharger, the recording medium being transported between said transfer means and said photosensitive member while contacting the surface of said photosensitive member; and shielding means provided in association with at least one of said corona dischargers or shielding said corona discharger to interrupt atmospheric contact with the surface of said photosensitive member, said shielding means comprising a hermetically sealed unit for confining at least one of said charging and transfer units therein.

2. An apparatus according to claim 1, wherein said unit comprises an endless belt movable while in surface contact with the surface of said photosensitive member.

3. An apparatus according to claim 2, wherein said endless belt moves at the same speed as the speed of said photosensitive member and in the same direction in which said photosensitive member moves at the time of image recording.

4. An apparatus according to claim 2, wherein said endless belt is movable at a different speed from the speed of said photosensitive member other than the image recording time.

5. An apparatus according to claim 2, wherein said endless belt is replaceable with another endless belt.

6. An apparatus according to claim 2, wherein a material for the endless belt is selected from the group consisting of nitrile rubber, chloroprene rubber, butyl rubber, fluorine-containing rubber, silicone rubber, isoprene rubber, styrene-butadiene rubber, urethane rubber, polyacrylic rubber, chlorosulfonated polyethlene rubber, polysulfide rubber, ethylene-propylene rubber, epichlorohydrin rubber, and polybutadiene rubber.

7. An apparatus according to claim 2, wherein a material for the endless belt is selected from the group consisting of nitrile rubber, chloroprene rubber, butyl rubber, fluorine-containing rubber, silicone rubber, isoprene rubber, styrene-butadiene rubber, urethane rubber, polyacrylic rubber, chlorosulfonated polyethlene rubber, polysulfide rubber, ethylene-propylene rubber, epichlorohydrin rubber, and polybutadiene rubber, and wherein metal particles selected from the group consisting of chromium, molybdenum, and tungsten is dispersedly diffused into the material of the endless belt.

8. An apparatus according to claim 7, wherein a material selected from the group consisting of tetrafluoroethylene resin, tetrafluoroethylene-hexafluoropropylene resin, and perchloroalkoxylpolymer is further coated on the endless belt.

9. An apparatus according to claim 1, wherein said shielding means comprises a unit for accommodating at least one of said charging and transfer units therein, means for introducing air into said unit, and means for exhausting gaseous matter out of said unit.

10. An apparatus according to claim 9, wherein said unit comprises an endless belt movable while in surface contact with the surface of said photosensitive member.

11. An apparatus according to claim 10, wherein said endless belt moves at the same speed as the speed of said photosensitive member and in the same direction in which said photosensitive member moves at the time of image recording.

12. An apparatus according to claim 10, wherein said endless belt is movable at a different speed from the speed of said photosensitive member other than the image recording time.

13. An apparatus according to claim 11, wherein said endless belt is replaceable with another endless belt.

* * * * *